US006457801B1

(12) United States Patent
Fish et al.

(10) Patent No.: US 6,457,801 B1
(45) Date of Patent: Oct. 1, 2002

(54) METHOD AND APPARATUS FOR MEASURING INK DRY TIME

(75) Inventors: Gerald Lee Fish, Versailles, KY (US); Philip Jerome Heink, Lexington, KY (US); Peter Brown Pickett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/892,978

(22) Filed: Jun. 27, 2001

(51) Int. Cl.[7] ..... B41J 29/393; B41J 29/38
(52) U.S. Cl. ..... 347/19
(58) Field of Search ..... 347/19, 14, 16, 347/7, 37, 102–105; 250/560

(56) References Cited

U.S. PATENT DOCUMENTS

| | | | |
|---|---|---|---|
| 3,734,626 | A | 5/1973 | Roberts et al. |
| 4,207,467 | A | 6/1980 | Doyle |
| 4,464,050 | A | 8/1984 | Kato et al. |
| 4,565,450 | A | 1/1986 | Wirz et al. |
| 4,575,249 | A | 3/1986 | Grieger |
| 4,787,238 | A | 11/1988 | Seki et al. |
| 4,859,062 | A | 8/1989 | Thurn et al. |
| 4,863,268 | A | 9/1989 | Clarke et al. |
| 4,866,287 | A | 9/1989 | Weber |
| 4,976,545 | A | 12/1990 | Kipphan et al. |
| 5,045,342 | A | 9/1991 | Boissevain et al. |
| 5,139,344 | A | 8/1992 | Mutter |
| 5,162,865 | A | 11/1992 | Kipphan et al. |
| 5,367,379 | A | 11/1994 | Makino |
| 5,392,125 | A | 2/1995 | Reisser |
| 5,406,315 | A | 4/1995 | Allen et al. |
| 5,689,757 | A | 11/1997 | Ferrante et al. |
| 5,764,251 | A | 6/1998 | Hashimoto |

*Primary Examiner*—Craig A. Hallacher
*Assistant Examiner*—Charles W. Stewart, Jr.
(74) *Attorney, Agent, or Firm*—Taylor & Aust P.C.

(57) ABSTRACT

A dry time sensor apparatus for an ink jet printer includes a light source emitting light onto a selected area of ink on a print medium such that the light reflects off of the selected area of ink. A reflective device receives the reflected light and reflects the light a second time back onto the selected area of ink such that the light is reflected a third time by the selected area of ink in a predetermined direction. The predetermined direction is substantially nonvarying over a range of angles of orientation of the print medium and a range of distances of the print medium from the light source. A reflected light detecting device receives the light reflected in the predetermined direction.

20 Claims, 11 Drawing Sheets

METHOD AND APPARATUS FOR MEASURING INK DRY TIME

BACKGROUND OF THE INVENTION

1. Field of the Invention

The present invention relates to a method and apparatus for measuring the dry time of ink, and, more particularly, to a method and apparatus for measuring the dry time of ink in an ink jet printer.

2. Description of the Related Art

Ink jet printers are known to have a print quality problem related to ink dry time. Suppose that a page is printed and ejected from an ink jet printer. A second page is then printed and ejected onto the first page. If the ink from the first page is not yet dry, then the ink on the first page will smear, and/or some portion of the ink will transfer to the back of the second page.

It is known to provide mechanical devices to keep the second page from touching the first page for as long as possible. After the second page is printed, the mechanical device allows the second page to fall gently onto the first page. A problem is that smearing can still occur if the ink on the first page is not yet dry.

It is also known to blow air across the first page, in an attempt to accelerate evaporative drying. This method adds cost and size to the printer.

Another method is to hold the second page in the printer for a predetermined amount of time until the first page has had time to dry completely. Obviously this decreases the printer's throughput rate.

What is needed in the art is a method of determining when ink on the first page is dry so that the second page may then be ejected from the printer, thereby optimizing printer performance.

SUMMARY OF THE INVENTION

The present invention provides a method and sensor apparatus for accurately detecting, under various conditions, whether ink is dry on a print medium.

The present invention comprises, in one form thereof, a dry time sensor apparatus for an ink jet printer. A light source emits light onto a selected area of ink on a print medium such that the light reflects off of the selected area of ink. A reflective device receives the reflected light and reflects the light a second time back onto the selected area of ink such that the light is reflected a third time by the selected area of ink in a predetermined direction. The predetermined direction is substantially nonvarying over a range of angles of orientation of the print medium and a range of distances of the print medium from the light source. A reflected light detecting device receives the light reflected in the predetermined direction.

It is easy to look at the surface of wet ink and determine that it is wet. This judgment is commonly made based on the shininess of the surface. An ink dry time sensor is essentially designed to allow some objective measurements of shininess (gloss) of a given area to be made over time. The general idea is that the drying of the ink/paper can be correlated with these measurements of shininess. An ink dry time sensor attempts to measure the light that is reflected and scattered from the surface of a page onto which ink has been applied in some pattern (the print pattern).

A light source is directed to the surface of the paper and some number of photo sensors are placed so as to measure the amounts of the reflected light in various positions over time. Generally, one photo sensor is positioned such that it receives a peak reading if all of the light is spectrally reflected from the surface of the page. Ideally, the reflective sensor should be placed such that its centerline is coincident with the centerline of the illumination ray after it is reflected from the surface of the paper. The assumption being that the paper (with wet ink on its surface) might reflect the light in the same way as a perfect mirror might.

One potential problem with the sensor is that the measured amount of specularly reflected light can vary dramatically if the sensor moves relative to the paper or if the shape of the paper changes during its operation. The positioning if the sensor relative to the paper is largely a matter of accurate feeding of the paper and mounting of the sensor. The movement and deformation of the paper is a common occurrence resulting from the relaxation of mechanical stresses in the paper as the ink is absorbed (cockle and curl). The variations in the measurements from the reflective sensor due to these paper movements can easily overshadow the signal in which we are interested.

The present invention minimizes the effects of positional tolerances and paper deformation by using a beam splitter and a retro-reflective surface.

The method of the present invention provides a theory for the operation of the ink dry time sensor and processes that can be used to determine the "dry time" (and associated information about drying) from the data supplied by the sensor hardware.

An advantage of the present invention is that the sensor can compensate for small deformations and movements of the paper. Thus, the sensor is accurate and easy to use.

Another advantage of the present invention is that ejected sheets of paper are stacked as soon as the ink is dry, thereby maximizing the printer's rate of throughput and minimizing resulting smear and offset print quality defects.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
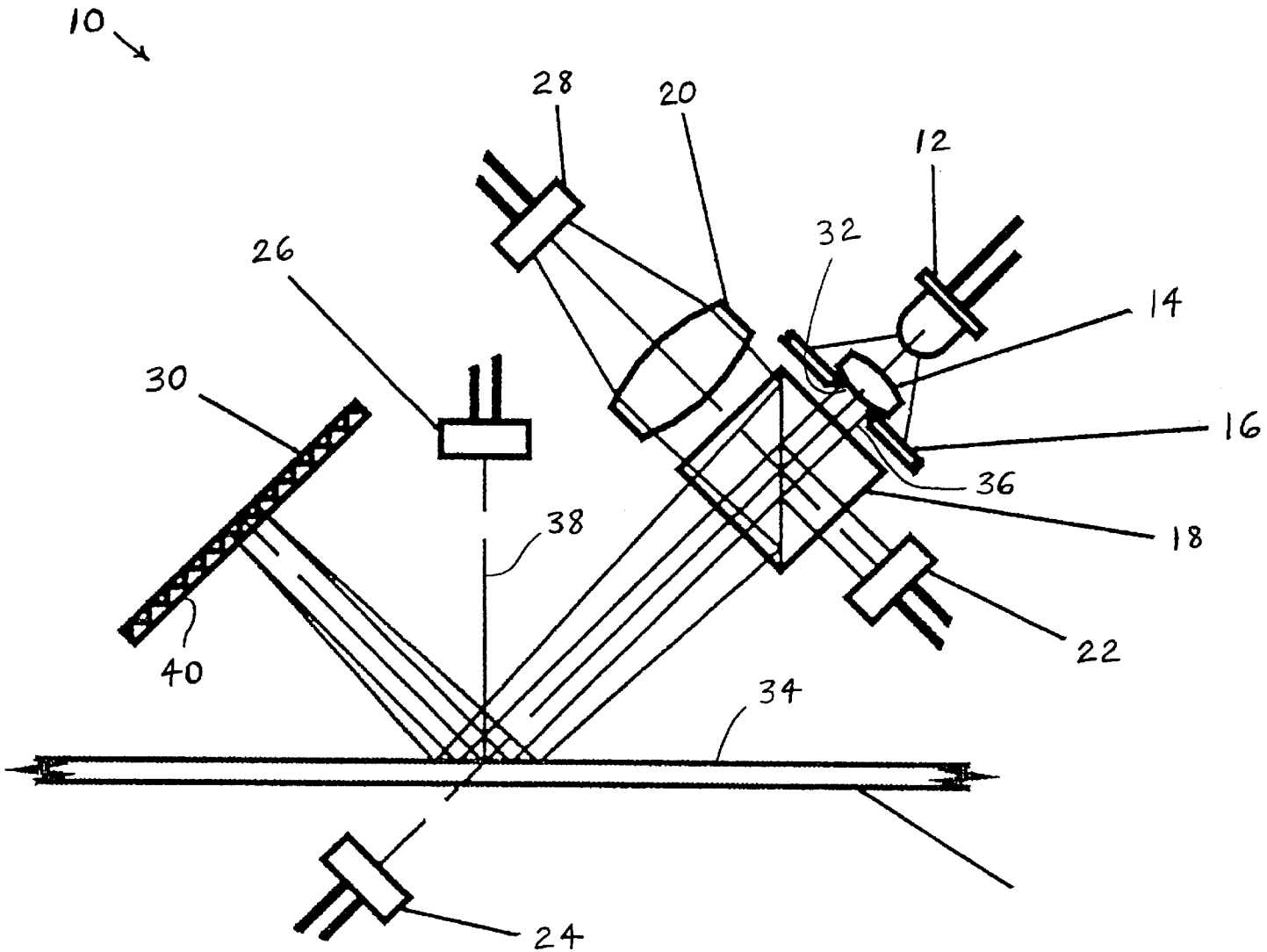
FIG. 1 is a schematic, side view of one embodiment of a dry time sensor of the present invention.

Referring now to the drawings, and particularly to FIG. 1, there is shown one embodiment of a dry time sensor apparatus 10 of the present invention, including a light source 12, collimation lens 14, mask 16, beam splitter 18, collection lens 20, photosensors 22, 24, 26, 28, and retro-reflective device 30.

Light source 12 can be a light emitting diode or laser diode. Any visible or near infrared wavelength can be used. This light is collimated by collimation lens 14. Alternatively, the light can be collimated through a transparent plastic package on light source 12.

Mask 16 includes an aperture 32 for shaping the light. Aperture 32 determines the size and shape of an area on a sheet of paper 34 that will be sampled. Ideally, the light intensity should be uniform over this area. A beam of collimated light 36 passes through cube-type beam splitter 18. Other types of beam splitters might also be employed including a half-silvered mirror, or a diffractive, optical element. Photosensor 22 is in the path of the light that is immediately deflected at beamsplitter 18. Photosensor 22 monitors and/or compensates for drift in the output power of light source 12.

From beam splitter 18, the light is directed towards paper 34. Some portion of the light is reflected from paper 34 at the angle of incidence and in a plane defined by the incoming beam and an outward-pointing line 38 normal to paper 34 at the point of reflection. It is this light that is most sensitive to the relative position and shape of paper 34.

Photosensor 26 is placed above paper 34 to obtain a representative measurement of the amount of light that is scattered by paper 34 via diffuse reflection. Since wet paper is typically more translucent than dry paper, photosensor 24 is placed beneath paper 34 to obtain information about the transmission of light through paper 34.

Retro-reflective device 30 has a retro-reflective surface 40 placed so that it intercepts the reflected beam. Surface 40 is large enough so that it captures the specularly reflected portion of the light under the worst possible combinations of paper/sensor position error and paper cockle and curl. The relocation and scattering of the light due to retro-reflector 30 is kept to a minimum. Retro-reflector 30 includes a molded panel with very small molded internally reflecting corners. Some type of reflector using transparent microspheres might also be a low-cost substitute.

Figure 2A:
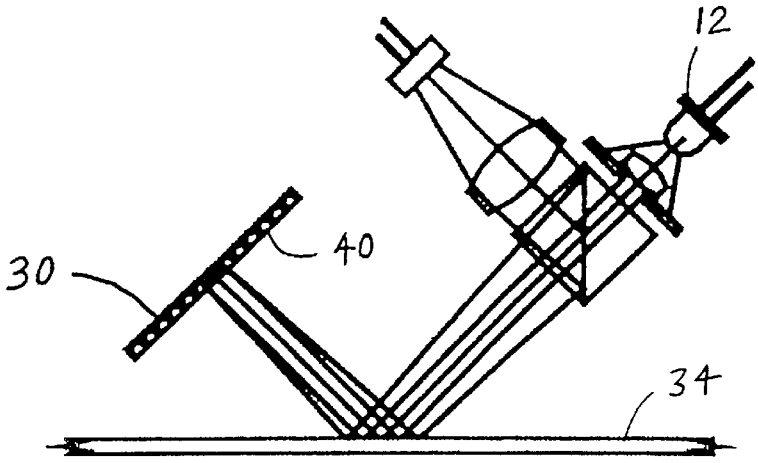
FIG. 2*a* is a schematic, side view of the dry time sensor of FIG. 1 with the paper in a normal position.
Figure 2B:
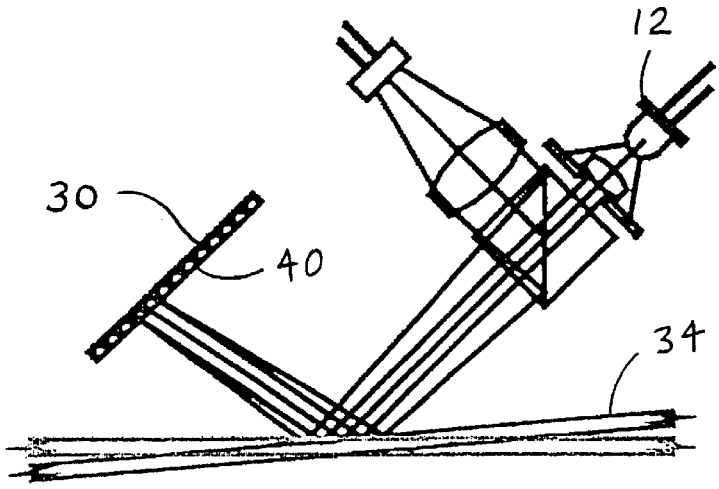
FIG. 2*b* is a schematic, side view of the dry time sensor of FIG. 1 with the paper in a tilted position.
Figure 2C:
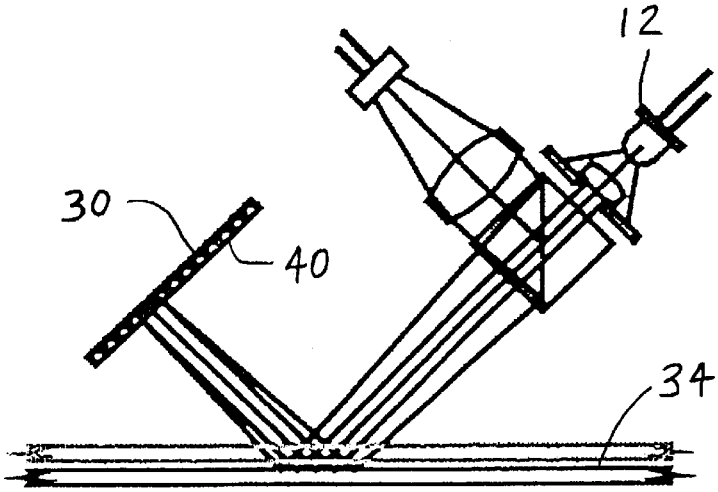
FIG. 2*c* is a schematic, side view of the dry time sensor of FIG. 1 with the paper in a lowered position.

The light reflected from retro-reflector 30 is generally returned along the same path from which it came from the paper 34, except for some scattering due to imperfections in retro-reflector 30. Thus, the light is reflected a second time off of paper 34, and generally back in the direction toward light source 12. As illustrated in FIGS. 2*a*–2*c,* retro-reflector 30 compensates for various movements and deformations of paper 34.

When paper 34 is tilted as shown in FIG. 2*b,* the light reflects off of a lower portion of retro-reflective surface 40. The light is reflected a second time off of paper 34 and in the direction of light source 12, just as in the case where paper 34 is not tilted. When paper 34 is lowered as shown in FIG. 2*c,* the light again reflects off of a lower portion of retro-reflective surface 40 and is reflected a second time off of paper 34 in the direction of light source 12. In this way, retro-reflector 30 compensates for various movements and deformations of paper 34 within a reasonable range of motion.

The beam, having been reflected back off of paper 34 a second time, returns to beam splitter 18. A portion of the light is reflected to collection lens 20. Some other portion of the light may be scattered by retro-reflector 30 and further scattered in its second reflection off of paper 34. Collection lens 20 collects the light and concentrates it on photosensor 28. Photosensor 28 provides a more accurate indication of the amount of light that is spectrally reflected from the surface of paper 34 and the ink. It is this signal, when properly normalized, which gives the most accurate indication of the fraction of printed ink that is still liquid at the surface of paper 34.

Light rays striking a free surface of ink will reflect specularly. That is, there is very little scattering of the reflected light and the angle of reflection is equal to the angle of incidence, relative to a line normal to the free surface of ink. When a sufficient amount of ink is introduced to the surface of paper, e.g., by printing a solid area of black or some color, it can be assumed that there is some time during which the ink has a free surface that is above the surface of the paper. For all practical purposes, the paper beneath the surface of the ink does not affect the way in which the light is reflected from the surface of the ink.

As the ink "dries", either by absorption into the paper, evaporation, or some other phase change, the optical properties of the surface will generally change. Since the ink's absorption into the paper is the main concern, the depth of the ink can be thought of as decreasing. Gradually, paper fibers will begin showing through the surface of the ink and light will be scattered, i.e., reflected diffusely, from this more irregular surface, and a smaller portion of light will be reflected specularly. Eventually, the ink will distribute itself into the paper and onto its surface according to the surface properties of the ink and the paper. The total system will then be in thermodynamic equilibrium. At this point, changes in the optical properties of the surface will stop. Obviously, when all changes in reflectance stop, the ink/paper can be considered to be "dry". In practice, however, this type of analysis is not really very useful.

Figure 3:
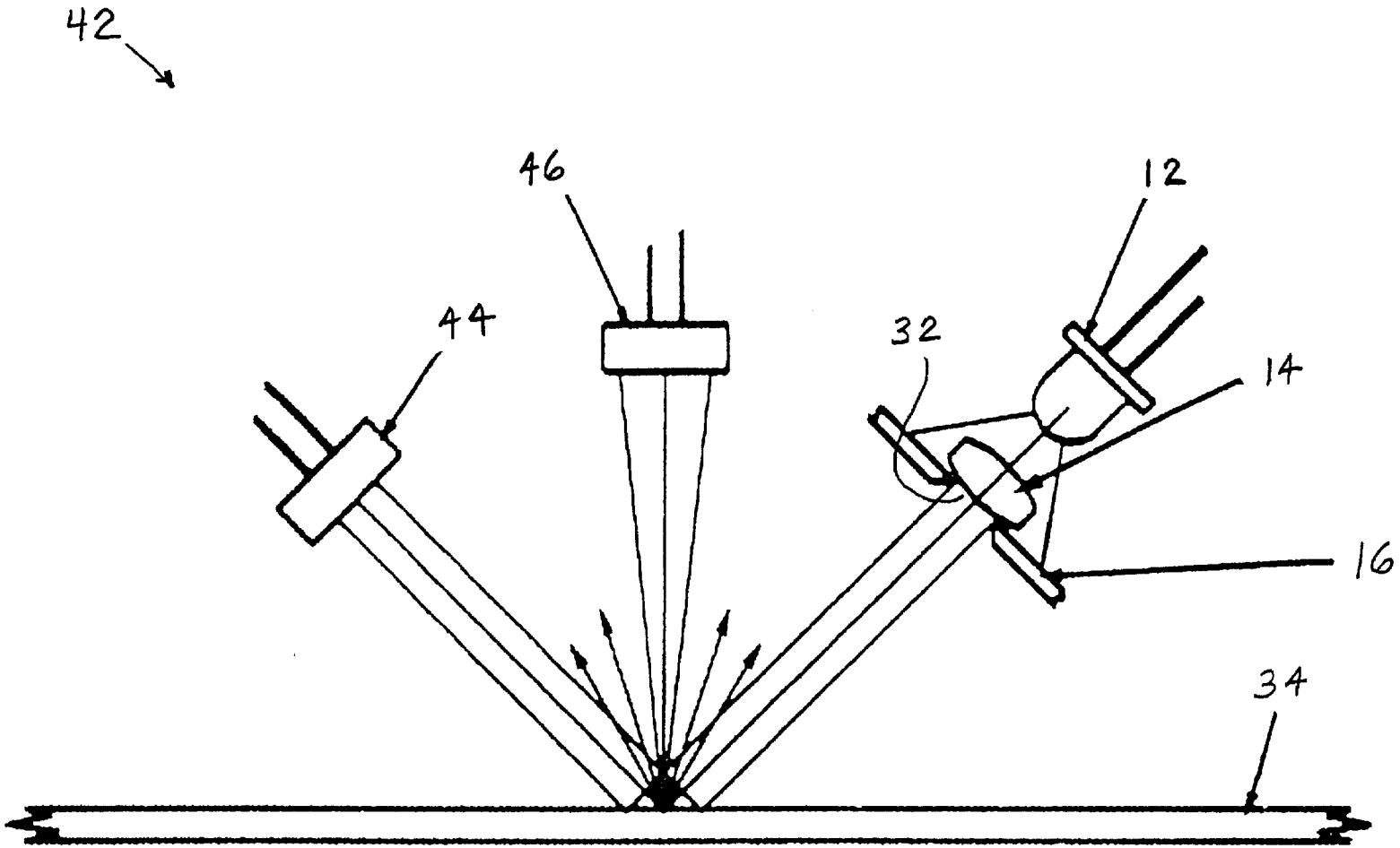
FIG. 3 is a schematic, side view of another embodiment of a dry time sensor of the present invention.

In the simple dry time sensor 42 shown in FIG. 3, light from light source 12 is introduced to the surface of paper 34 at some angle. The light illuminates some area of paper 34 that is determined by the size and shape of aperture 32. It can be assumed that the illumination intensity over that area is somewhat uniform. This light might be absorbed at the surface, transmitted though the surface, or reflected from the surface. However, it can be assumed that the light that is reflected from the surface is predominant, and that the absorbed and transmitted light, and any light from other sources, is negligible. A reflective photosensor 44 is placed at the angle of reflection, and a diffuse photosensor 46 is placed normal to the paper surface.

Figure 4:
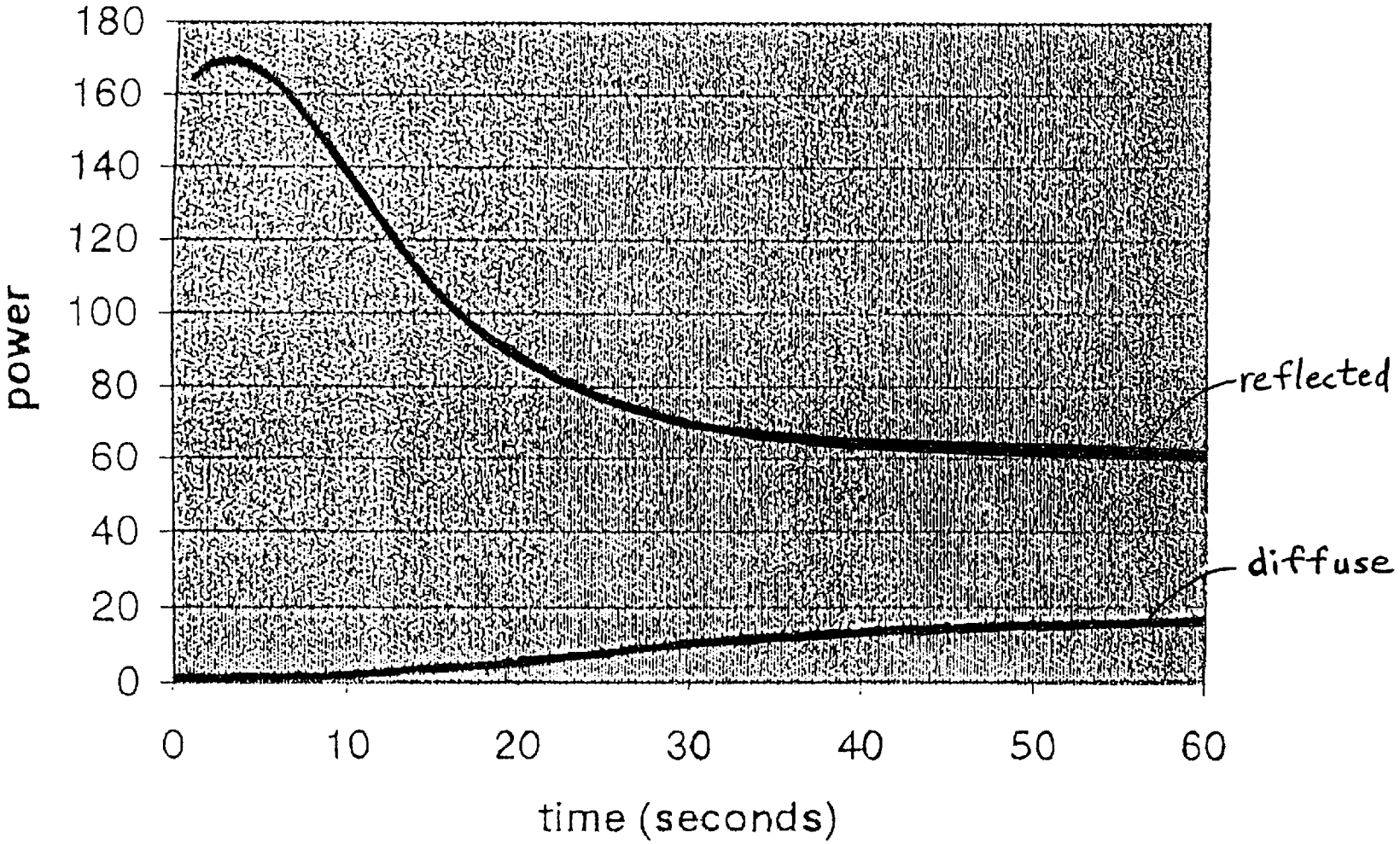
FIG. 4 is a plot of reflected light power and diffuse light power versus time.

If the area of the surface onto which the light is directed is glossy, as it will be if it is wet with ink, reflective photosensor 44 receives most of the light and diffuse photosensor 46 receives a relatively small amount of light. Under other circumstances, such as either dry ink/paper or unprinted paper, the amount of reflected light might be lower, but the amount of diffuse light is higher. Such data can be recorded as a function of time and plotted. The upper and lower plots of FIG. 4 show the amount of light at reflective sensor 44 and diffuse sensor 46, respectively, plotted as a function of time. The area sensed was printed with black ink (100% coverage) at time=0 second. It is also instructive to view this data in terms of a parametric trajectory through a plane defined such that the reflective power is plotted on the vertical axis and the diffuse power is plotted on the horizontal axis. Such a plot, using the same data as FIG. 4, is shown in FIG. 5.

Figure 5:
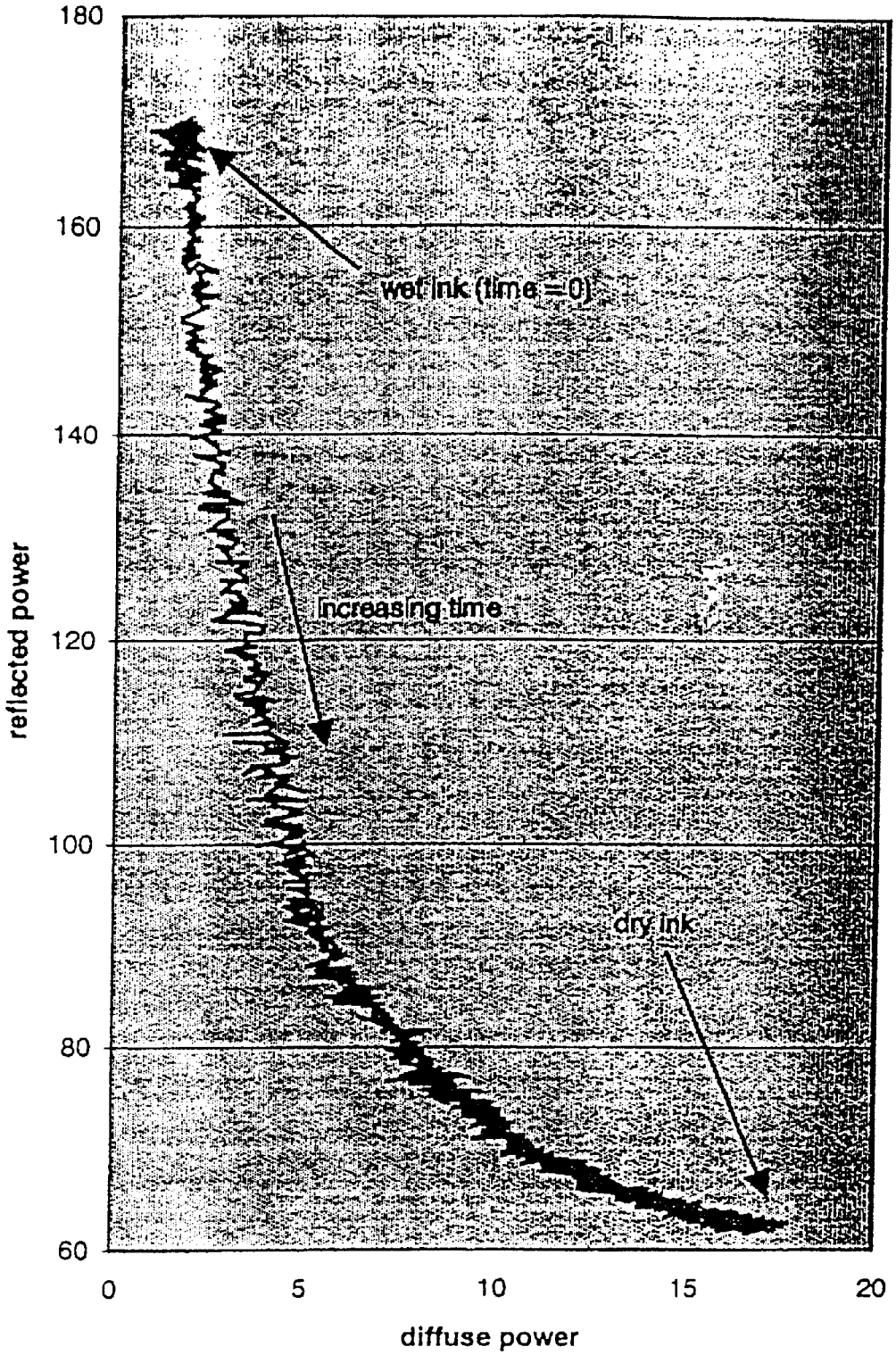
FIG. 5 is a plot of reflected light power versus diffuse light power.

A "velocity" associated with the movement along the trajectory shown in FIG. 5 can be described. In the beginning (t=0), the velocity is very small. This is somewhat expected if one visualizes a puddle of ink as it is absorbed into the paper. As long as the surface is smooth and undisturbed, it will be glossy. Only when the surface is disrupted by the relatively rough surface paper that is exposed underneath will the surface begin to reflect the light more diffusely. As the surface changes, the light is reflected differently and trajectory begins to move toward the dry point more rapidly. As it nears the dry point however, the velocity decreases again. The velocity of the trajectory from FIG. 5 is plotted versus time in FIG. 6.

Because of non-uniformities in and on the paper as well as other physical forces, e.g., flow of ink due to surface tension gradients, the ink depth and rate of absorption is not the same in all areas of the paper. Consequently, the optical properties of the surface are not uniform and vary from one place to another over the surface of the paper. In other words, the ink appears to dry at different times in different parts of the paper. For this reason, the location and size of the observed area is important. It is then reasonable to assume that a larger area of observation will give a more repeatable average of the optical properties of the surface than will a small area.

The data presented above has all been for a solid area of printed ink, i.e., 100% coverage. It is desirable to be able to efficiently analyze data gathered from areas in which an arbitrary pattern is printed. To facilitate this, a simplifying assumption is made that, at any time, at any arbitrary infinitesimal portion of the observation area the surface will be in one of three states. That is, the surface can either be: wet, with ink forming a free surface; dry, with the ink and paper in equilibrium; or unprinted, with no ink on the paper.

Figure 7:
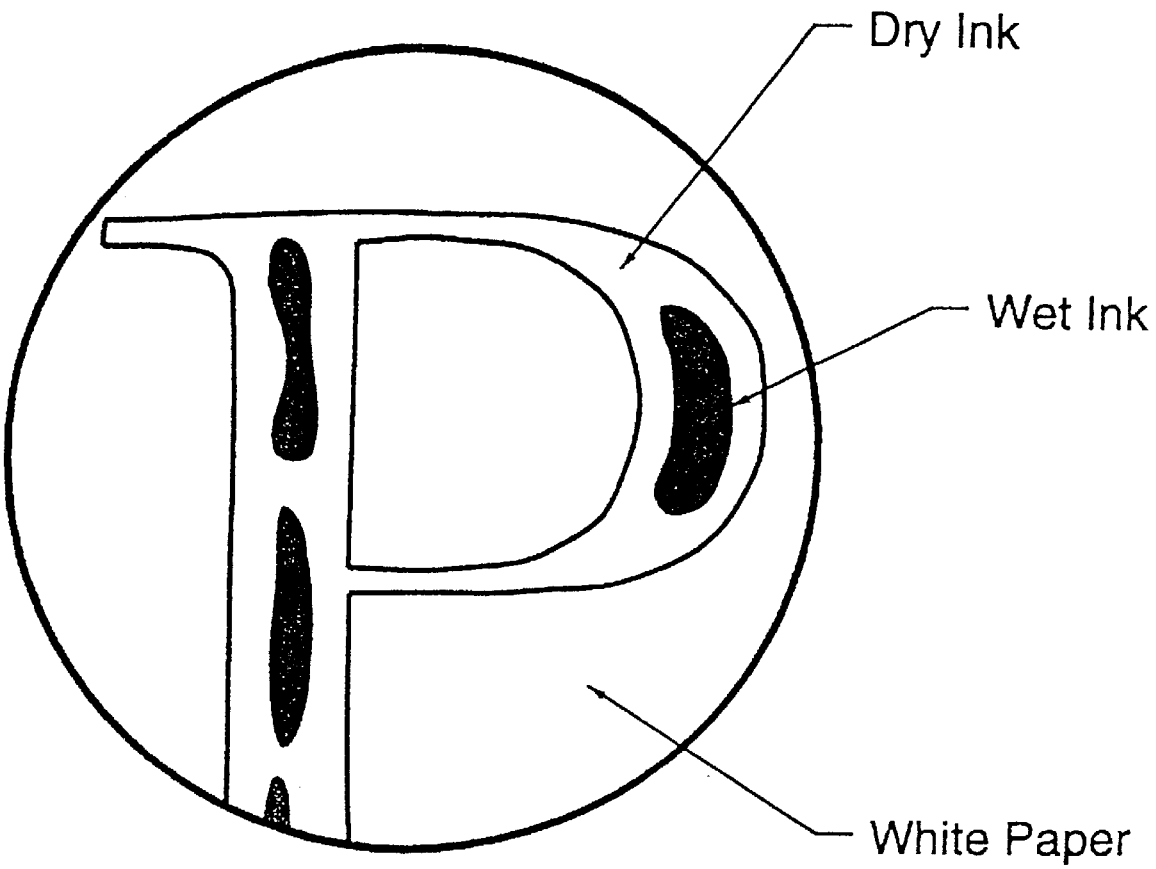
FIG. 7 is an enlarged view of an observation area of a printed sheet.

A typical observation area is shown in FIG. 7. The optical properties of these three states can be measured using sensors 44, 46 and looking at a uniform area to obtain the reflective and diffuse readings for each. The readings are already available for the wet ink and dry ink states, and are shown in FIG. 5. By taking a reading with the sensor on unprinted paper, the readings for the third state, i.e., white paper, can be obtained.

Figure 8:
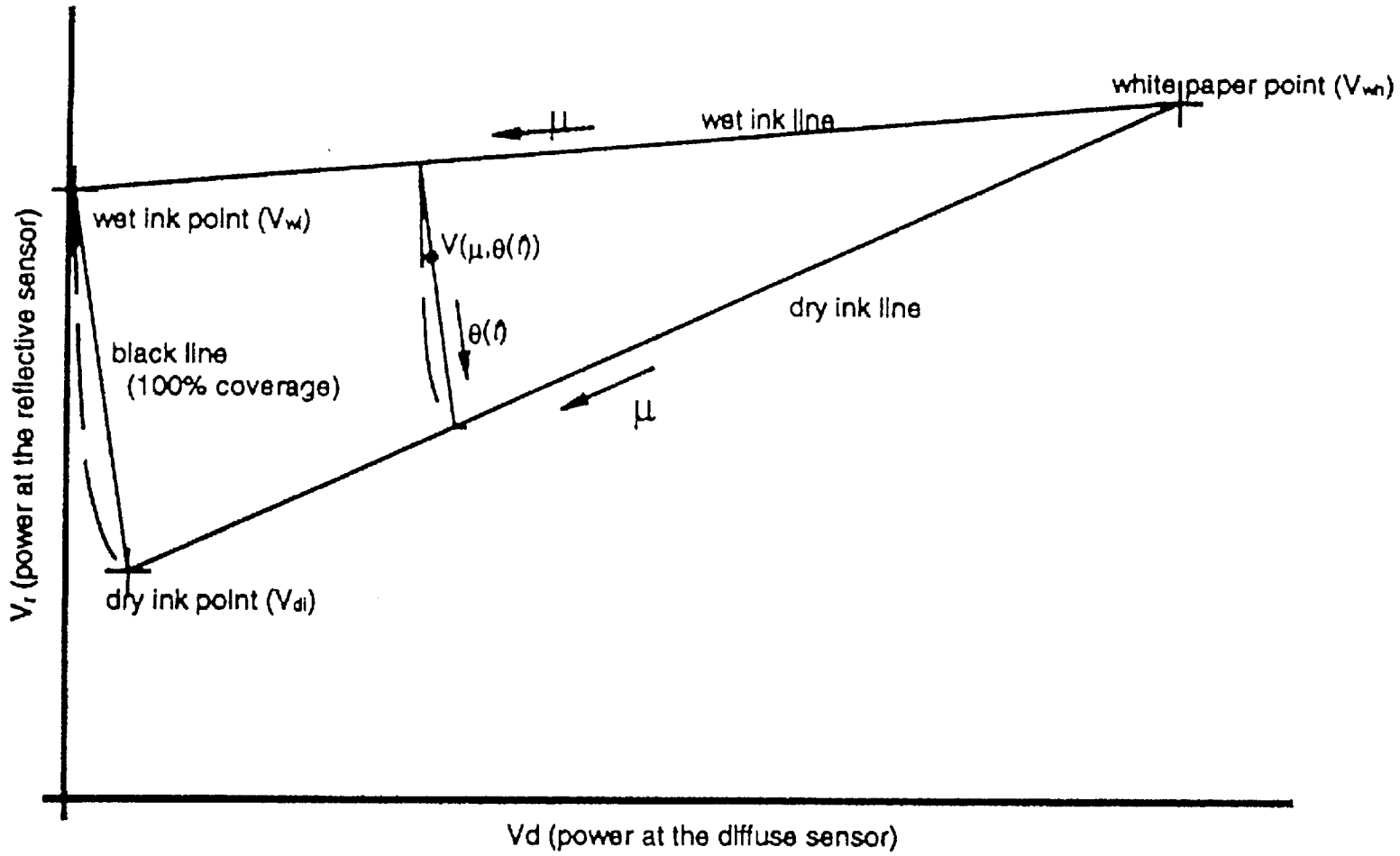
FIG. 8 is a plot of reflected light power versus diffuse light power at a wet ink point, a dry ink point, and a white paper point.

These three states can be imagined to be the three corners of a triangle plotted in the same plane as was used in FIG. 5, and the points are labeled $V_{wi}$ (wet ink), $V_{di}$ (dry ink), and $V_{wh}$ (white paper) in FIG. 8. During the drying process, the sensor outputs, which measure the response to a combination of these three points, generally remain inside the triangular area defined by these points. Thus, at some instant in time (t), the location in this plane, i.e., the measurements from diffusive sensor 46 and reflective sensor 44, is the area-weighted average of the measurements from these three points $V_{wi}$, $V_{di}$, and $V_{wh}$. This is facilitated through the definition of two variables $\mu$ and $\theta(t)$. The variable $\mu$ is the ratio of printed area to total area, and ranges from 0 for white unprinted paper to 1 for 100% ink coverage, which is constant for a given measurement area. The variable $\theta(t)$ is the ratio of wet ink area to printed area, and ranges from 1 when all of the ink is wet to 0 when all of the ink is dry.

Assuming that these variables $\mu$ and $\theta(t)$ are known, the approximate sensor measurements for some pattern can be predicted, and are given by the following Equation 1:

$$V(t)=\mu\theta(t)V_{wi}+\mu(1-\theta(t))V_{di}+(1-\mu)V_{wh}$$

where V can be used to represent either the diffusive or reflective measurement, or some combination of the two.

Solving Equation 1 for $\theta(t)$, the following Equation 2 is obtained:

$$\theta(t)=\left(\frac{V_{di}-V_{wh}}{V_{di}-V_{wi}}\right)-\frac{1}{\mu}\left(\frac{V(t)-V_{wh}}{V_{di}-V_{wi}}\right)$$

Equation 2 suggests a reasonable way in which to normalize the measurements. More importantly, it shows that $\theta(t)$ can be expressed as a linear function of some combination of the sensor measurements. In a practical situation, some help in identifying the constants in Equation 2 is obtained by using two simple assumptions about $\theta$. At the time the ink is printed onto the paper (t=0), it is assumed to be wet and so $\theta(t=0)=1$. Eventually ($t\rightarrow\infty$) there will be some equilibrium at which the ink can be considered to be dry and so $\theta(t\rightarrow\infty)=0$.

From a practical point of view, the drying curve can be determined for a solid printed area ($\mu=1$) by averaging the first part of the data, e.g., at time t<1 second, to obtain an estimate for $V_{wi}$. Assuming that data was taken over a long enough time that it reaches steady state, the last part of the data can be averaged in order to obtain an estimate for $V_{di}$. Thus, the following Equation 3 is obtained:

$$\theta(t)=\frac{V_{di}-V(t)}{V_{di}-V_{wi}}=\frac{\overline{V}(t\rightarrow\infty)-V(t)}{\overline{V}(t\rightarrow\infty)-\overline{V}(t\rightarrow 0)}$$

for the case when $\mu=1$.

The actual trajectory defined by the data through the plane shown in FIG. 5 is generally not a straight line, but it can be reasonably approximated as such. As mentioned previously, the measurements (V(t)) in Equation 2 can represent either those from diffuse sensor 46, from reflective sensor 44, or some combination of that data. One convenient way of combining the data from both reflective sensor 44 and diffuse sensor 46 is to project the data on the trajectory curve onto the line joining the "wet ink point" and the "dry ink point".

Other data might be taken using other types of sensors including optical transmittance, capacitance, temperature, color, etc. All of these might yield data that changes as the fluid (ink) dries or otherwise changes state on the paper or other media or surface. Such data can be analyzed in the same manner as is described here to obtain information about the process.

Ultimately, the proper selection or combination of various data must be related to some physically significant interpretation of "dryness" relative to its acceptability for a particular application. For example, the use of the diffuse reflectivity measurement and the specular reflectivity measurement is discussed herein. The diffuse measurement typically has a longer time constant and continues to change even after the reflective measurement achieves a steady state. In the diffuse data, some transport of ink within the paper may be observed after the liquid ink on the surface is gone. Therefore, more attention should be paid to the diffuse measurement if there is a concern about the ink offsetting from the paper, for example, if the paper passes through some type of pressure rollers. If, however, only the surface ink is of importance, as in the case of the paper gently contacting another sheet, then closer attention should be paid to the reflective sensor data.

Since $\theta(t)$ actually represents the area ratio of printed ink that is still wet, it provides a convenient way of measuring and visualizing the drying process for any print pattern, ink, and paper. The drying process can be described in terms of this function ($\theta(t)$) and is referred to herein as the "drying curve".

The variable $\theta(t)$ can be used to describe the "degree of dryness" for a given sample. Based on this, the drying time can be defined in a meaningful way. For example, if a drying time is arbitrarily defined to be that time at which at least 90% of the sample is dry, then this time, $t_{90}$, can be found as that time when $\theta(t_{90})=0.10$, i.e., that time when 0.10 of the observed printed area is still wet and glossy. Other dry times can be similarly defined and all can be interpreted in terms of the remaining area of wet ink on the page, either as a ratio to the total printed area or as an absolute area.

Figure 9:
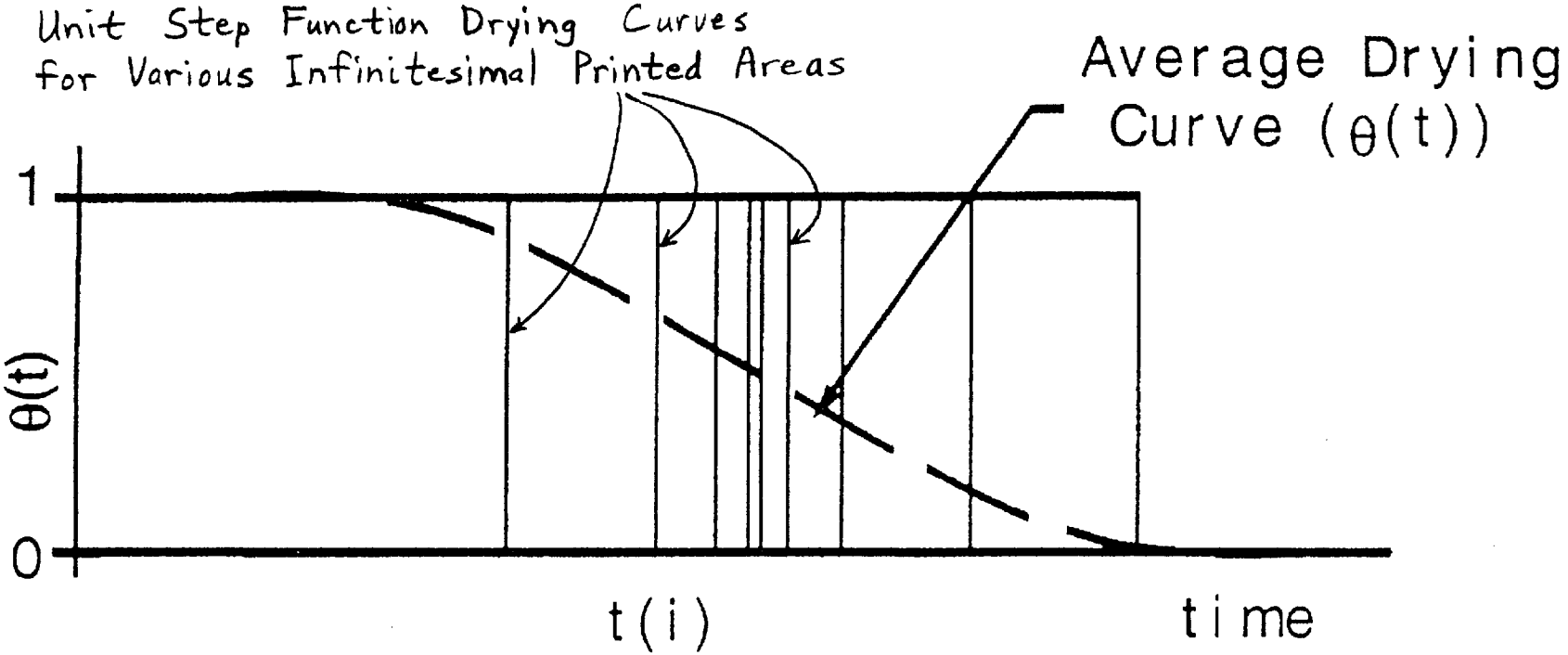
FIG. 9 is a plot of the ratio of wet ink area to printed area versus time.

It is clear from simple visual observations of ink drying on paper that ink does not typically dry all at one time on paper. Some areas become dry quickly and other areas seem to take a longer time to dry. This is also observed in the data collected using dry time sensor 42. Typically, the drying process takes place over some period of time. On the other hand, if an infinitesimal printed area (dA) in the observation area of the sensor is considered, it is reasonable to assume that this area of ink will dry at a discrete time ti after printing. Thus, the drying curve for this infinitesimal area might be given as the following Equation 4:

$$\theta_i(t)=1-u(t-t_i)$$

where $u(t-t_i)$ is the unit step function. This means that at any time less than $t_i$, $\theta_i(t)=1$ and the ink is wet. At $t_i$, the ink dries instantly and thereafter, $\theta_i(t)=0$. An average drying curve formed as a combination (by time averaging) of many discrete drying curves is shown in FIG. 9.

As was mentioned above, the actual drying time varies from place to place on the paper and from time to time. To proceed in this analysis, assume that $t_i$ is random, but can be described by some probability density function that is a characteristic of the ink, paper, and possibly some environmental factors. For example, local variations in paper fiber orientation, surface chemistry, or coating thickness might all influence local drying characteristics.

As some finite observation area ($A=\int_i dA$) is again considered, it can be seen that its optical properties, i.e., overall gloss as measured by dry time sensor 42, will be the area weighted average of the optical properties of all the infinitesimal areas contained within it. The average drying curve ($\theta(t)$) for this area is then the sum of all of the individual drying curves (given in Equation 4) multiplied by their respective infinitesimal areas and then normalized by the total observed area (A). This is expressed in the following Equation 5:

$$\overline{\theta}(t)=\frac{\int_i [1-u(t-t_i)]dA}{A}$$

Note that because $0<t_i<\infty$, $\overline{\theta}(t=0)=1$ and $\overline{\theta}(t\rightarrow\infty)=0$.

With each of these areas having a randomly selected drying time ($t_i$), it can be seen that the average drying curve ($\overline{\theta}(t)$) will actually be the complement of the cumulative probability distribution function describing the distribution of the various drying times ($t_i$).

Figure 6:
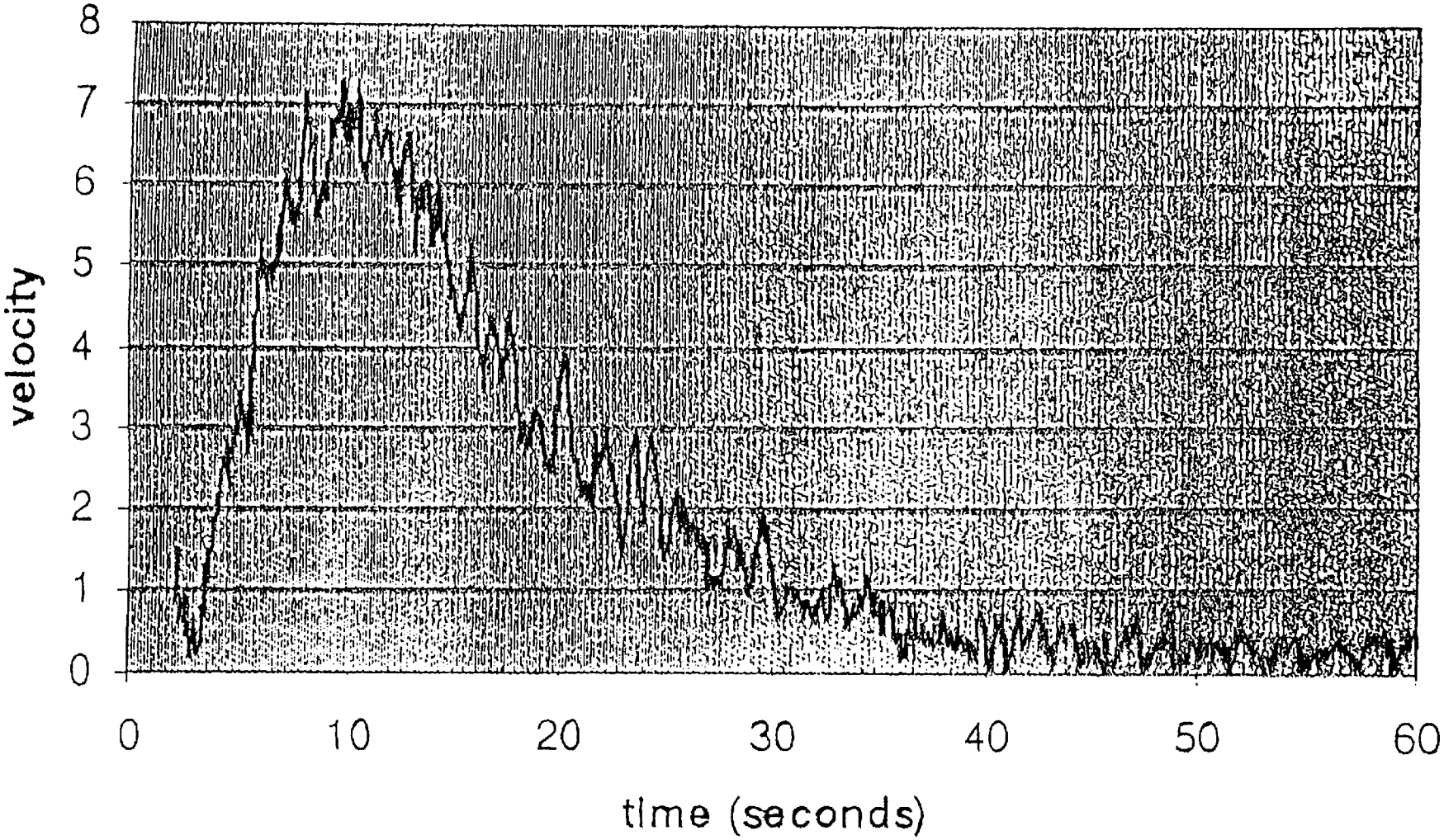
FIG. 6 is a plot of the velocity of the trajectory from the wet ink point of FIG. 5 to the dry ink point of FIG. 5.

It follows then that the probability density function is just the negative of the time derivative of this cumulative probability distribution function. More specifically, the cumulative probability distribution function for the $t_i$'s is $1-\theta(t)$ and the probability density function is $-\theta'(t)$. This probability density function is essentially equivalent to the "trajectory velocity" which is shown in FIG. 6.

Furthermore, the probability density function which results from the normalization of the data as described above can be efficiently described using the Gamma distribution, especially for areas of uniform ink coverage. The Gamma distribution, which typically describes the waiting times between events whose occurrences are governed by the Poisson Distribution, is described by the following Equation 6:

$$\gamma(t_m,\tau;t)=\frac{[1/\tau](t/\tau)^{t_m/\tau}e^{t/\tau}}{\Gamma(1+t_m/\tau)}$$

where $t_m$ and $\tau$ are parameters of the distribution. Note that $t_m$ is the modal time of the distribution and $\tau$ is a time constant (or "spread factor"). $\Gamma$ is the Gamma Function (generalized factorial), which is defined by the following Equation 7:

$$\Gamma(x+1)=\int_0^\infty \xi^x e^{-\xi}d\xi$$

The cumulative Gamma distribution is given as the integral from 0 to some time t, of the Gamma distribution, as shown in the following Equation 8:

$$P\left(t_m,\tau;\frac{t}{t_m}\right)=\frac{\int_0^{\frac{t}{\tau}}\xi^{\frac{t_m}{\tau}}e^{-\xi}d\xi}{\Gamma\left(1+\frac{t_m}{\tau}\right)}$$

Equation 8, the "Incomplete Gamma Function", is related to the drying curve as given in the following Equation 9:

$$\overline{\theta}(t)\approx 1-P\left(t_m,\tau;\frac{t}{t_m}\right)$$

Figure 10:
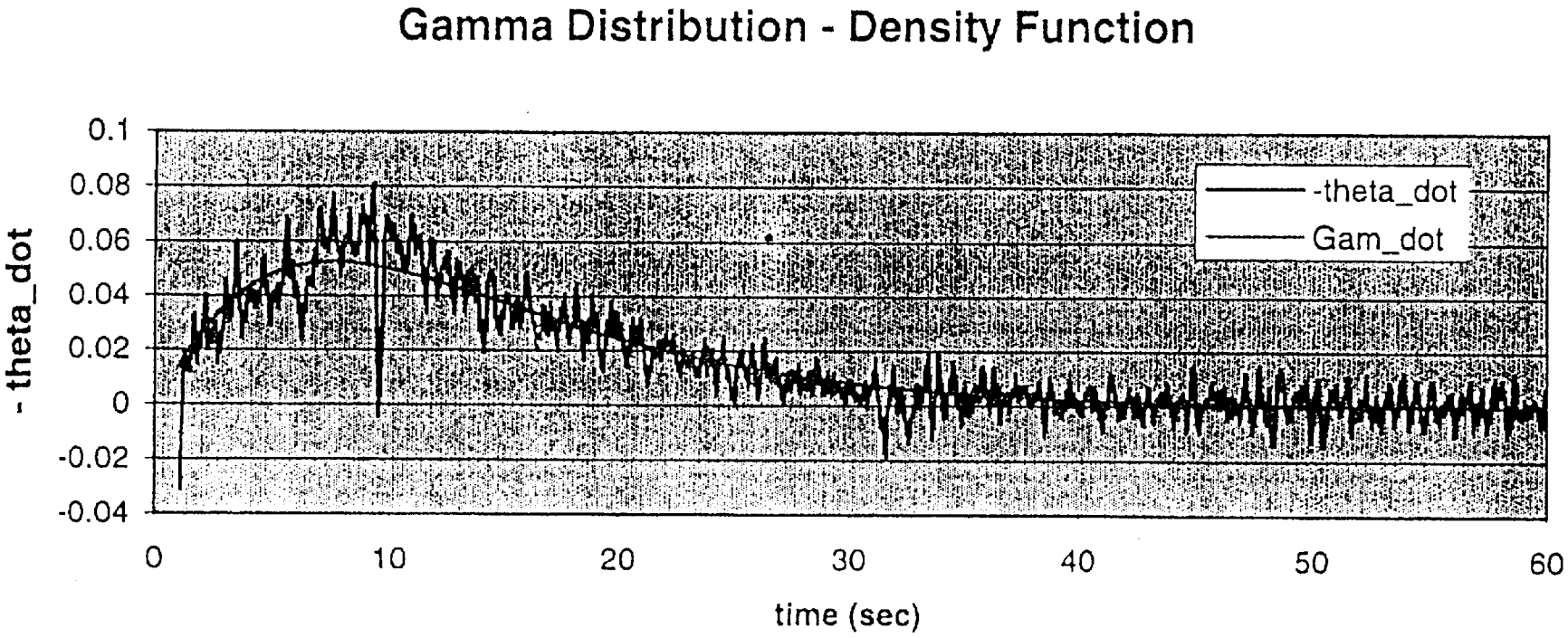
FIG. 10 is a plot of the negative of the first derivative of the ratio of wet ink area to printed area versus time, and a Gamma distribution as a function of time.
Figure 11:
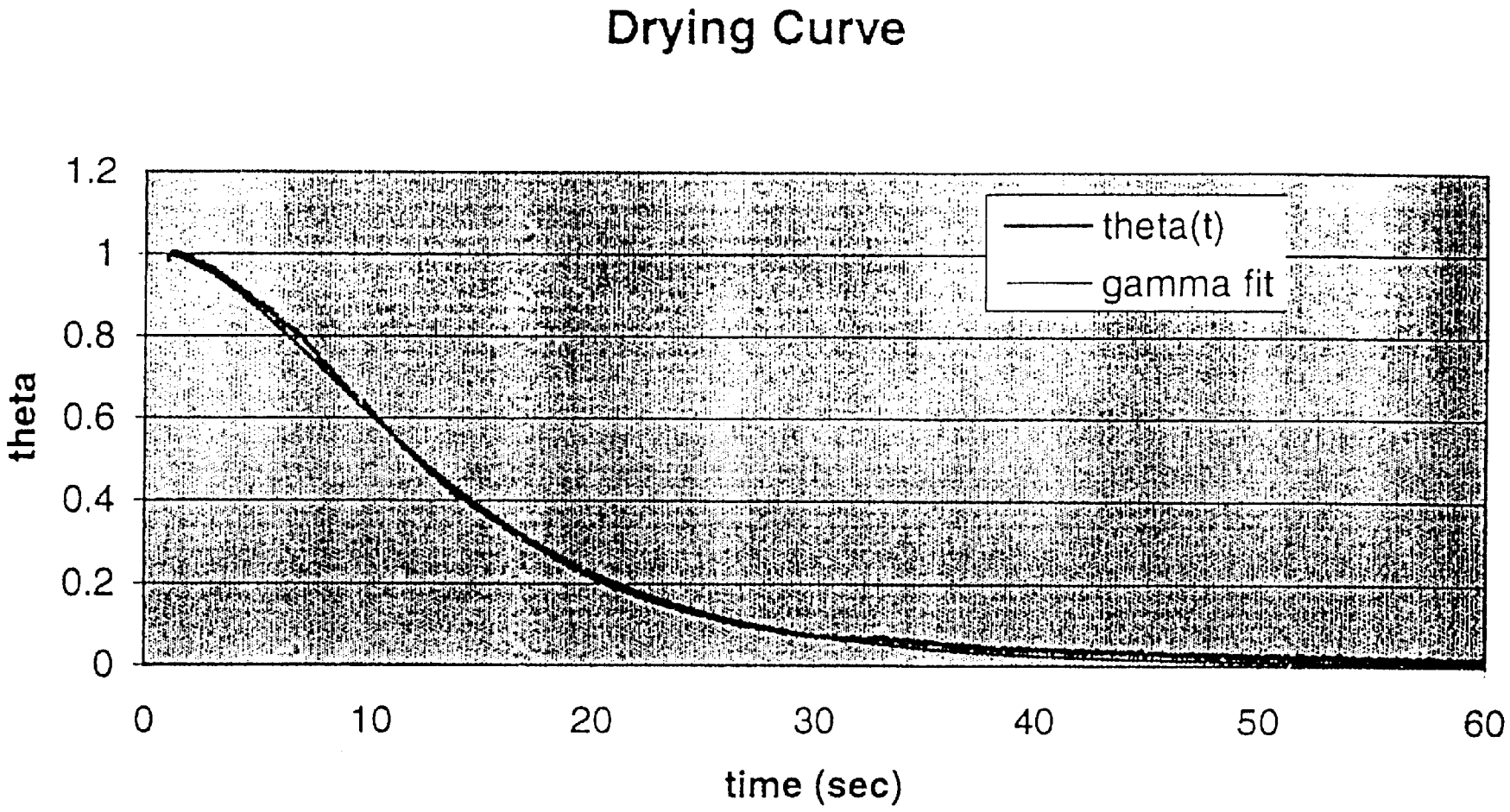
FIG. 11 is a plot of the ratio of wet ink area to printed area versus time, and a theoretical model of the wet ink area to printed area versus time according to the Gamma distribution.

Because of the similarity between the drying curve and the Gamma distribution, the Gamma distribution parameters tm and scan be used to accurately describe the drying curve. This is done by choosing these parameters such that the cumulative Gamma distribution best fits the drying curve data. This is most easily done numerically using any common optimization routine to minimize the sum of the squares of the error terms. Such a curve fit is shown in FIGS. 10 and 11. FIG. 10 is the drying curve shown with the cumulative Gamma distribution curve of best fit. FIG. 11 is the best fitting Gamma distribution with $-\theta'(t)$.

Because of noise in the dry time sensor data, actual dry time results can often be found more easily and reliably by referring to the best-fitting cumulative Gamma distribution curve rather than the actual data.

Up until this point, the term "dry time" has been used herein rather loosely to describe the time that the drying process takes. However, the drying process usually takes place over a period of time. Thus, a more specific definition for "dry time" is needed. Of course, the parameters of the best fitting Gamma distribution provide a technique of defining the dry time ($t_m$ is the time at which half of the inked area is dry) as well as a measure of the range of time over which the process takes place ($\tau$).

As previously discussed, another appealing way in which to define "dry time" is the time at which a given ratio of the printed area is dry. For example, $t_{90}$ can be defined at the time at which 90% of the printed area is dry.

Lastly, if the objective of knowing the dry time is to avoid ink smear and offset from one printed page to another, an assumption might be made about the probability of this occurrence, and its severity, based on the total area of wet ink in a given portion of the page. While this computation is more complicated and will not be discussed in detail here, it would provide the most directly useful information about the dryness of the page, i.e., the probability that smear or offset will occur.

In summary, referring to "dry time" by itself is not really meaningful. In reality, drying is not something which takes place all at once. By introducing the concept of the drying curve, the drying process can be observed in more detail. This can also be used to make meaningful statements about the dryness of the ink on paper. By using the parameters from the fitted cumulative Gamma distribution curve, it is possible to refer to parameters which give an indication as to when the drying rate is the fastest ($t_m$) as well as an indication as to how spread-out in time the drying process takes place ($\tau$).

The descriptions contained herein refer to ink jet printing on paper, but the same concepts can also be applied to many other printing and coating processes on many other types of media.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A dry time sensor apparatus for an ink jet printer, said apparatus comprising:

a light source configured to emit light onto a selected area of ink on a print medium such that the light has a first reflection, said first reflection being off of the selected area of ink;

a reflective device configured to receive the reflected light such that the reflected light has a second reflection, said second reflection being off of said reflective device, said second reflection being directed back onto the selected area of ink such that the light has a third reflection, said third reflection being off of the selected area of ink, said third reflection being directed in a predetermined direction, the predetermined direction being substantially nonvarying over a range of angles of orientation of the print medium and a range of distances of the print medium from said light source;

a reflected light detecting device configured to receive the light reflected in the predetermined direction; and a transmitted light detecting device configured to detect an amount of the light transmitted through the print medium.

2. The apparatus of claim 1, wherein said reflecting device comprises a retro-reflective device.

3. The apparatus of claim 1, further comprising a beam splitter configured to receive the light reflected in the predetermined direction, said beam splitter also being configured to reflect the light toward said reflected light detecting device.

4. The apparatus of claim 1, further comprising a collimation lens configured to collimate light directly received from said light source.

5. The apparatus of claim 4, further comprising a mask including an aperture configured to shape the collimated light.

6. The apparatus of claim 1, further comprising a collection lens configured to concentrate the light on said reflected light detecting device.

7. The apparatus of claim 1, further comprising a diffuse light detecting device configured to detect an amount of the light scattered by the print medium via diffuse reflection.

8. The apparatus of claim 1, wherein said predetermined direction is substantially nonvarying over said range of angles of orientation of the print medium and said range of distances of the print medium from said light source.

9. A dry time sensor apparatus for an ink jet printer, said apparatus comprising:

a light source configured to emit light;

a beam splitter configured to deflect a first portion of the light from the light source and pass a second portion of the light from the light source onto a selected area of ink on a print medium such that the light has a first reflection, said first reflection being off of the selected area of ink;

a monitoring light detecting device configured to receive the first portion of the light and thereby monitor an output power of said light source;

a reflective device configured to receive the reflected light such that the reflected light has a second reflection, said second reflection being off of said reflective device, said second reflection being directed back onto the selected area of ink such that the light has a third reflection, said third reflection being off of the selected area of ink, said third reflection being directed in a predetermined direction, the predetermined direction being substantially nonvarying over a range of angles of orientation of the print medium and a range of distances of the print medium from said light source, said beam splitter being configured to receive the light reflected in the predetermined direction such that the light has a fourth reflection, said fourth reflection being off of said beam splitter; and a reflected light detecting device configured to receive the light reflected off of said beam splitter.

10. A dry time sensor apparatus for an ink jet printer, said apparatus comprising:

a light source configured to emit light onto a print medium having ink thereon;

a reflective device configured to receive the light after the light has been reflected off of the ink, said reflective device also being configured to re-reflect the light off of the ink in a predetermined direction, the predetermined direction being substantially nonvarying over at least one of a range of angles of orientation of the print medium and a range of distances of the print medium from said light source;

a reflected light detecting device configured to receive the light re-reflected in the predetermined direction; and a diffuse light detecting device configured to detect an amount of the light scattered by the print medium via diffuse reflection.

11. The apparatus of claim 10, wherein said reflecting device comprises a retro-reflective device.

12. The apparatus of claim 10, wherein the predetermined direction is substantially opposite to a direction in which the light is reflected toward said reflective device.

13. The apparatus of claim 12, wherein said reflected light detecting device is configured to receive the light after the light has reflected off of the ink a second time.

14. The apparatus of claim 13, further comprising a beam splitter configured to receive the light that has reflected off of the ink the second time, said beam splitter also being configured to reflect the light toward said reflected light detecting device.

15. The apparatus of claim 14, wherein said beam splitter is configured to receive the light from said light source before the light has been reflected, said beam splitter also being configured to deflect a first portion of the light from the light source and pass a second portion of the light from the light source, said apparatus further comprising a monitoring light detecting device configured to receive the first portion of the light and thereby monitor an output power of said light source.

16. The apparatus of claim 10, further comprising a collimation lens configured to collimate light directly received from said light source.

17. The apparatus of claim 16, further comprising a mask including an aperture configured to shape the collimated light.

18. The apparatus of claim 10, further comprising a collection lens configured to concentrate the light on said reflected light detecting device.

19. The apparatus of claim 10, further comprising a transmitted light detecting device configured to detect an amount of the light transmitted through the print medium.

20. The apparatus of claim 10, wherein said predetermined direction is substantially nonvarying over a range of angles of orientation of the print medium and a range of distances of the print medium from said light source.

* * * * *